US005361612A

United States Patent [19]

Voiculescu et al.

[11] Patent Number: 5,361,612

[45] Date of Patent: Nov. 8, 1994

[54] HOOD LOCK WITH REEL AND CABLE

[75] Inventors: Danut Voiculescu, Cleveland; Mark Banez, Youngstown; Louis D. Carlo, Litchfield, all of Ohio

[73] Assignee: Winner International, Sharon, Pa.

[21] Appl. No.: 16,307

[22] Filed: Feb. 11, 1993

[51] Int. Cl.[5] ..... E05B 65/19

[52] U.S. Cl. ..... 70/241; 49/347; 70/257; 70/279; 242/376; 242/378.4; 242/384.7; 292/262; 292/DIG. 14; 296/76

[58] Field of Search ..... 70/257, 256, 241, 279; 49/347; 292/262, DIG. 14, DIG. 43; 242/107.4 R; 296/76

[56] References Cited

U.S. PATENT DOCUMENTS

| | | | |
|---|---|---|---|
| 1,433,675 | 10/1922 | Cashmer | 411/996 X |
| 2,550,203 | 4/1951 | Robinson | 292/DIG. 14 X |
| 2,726,826 | 12/1955 | Hoven et al. | 242/107.4 R |
| 2,837,372 | 6/1958 | Odom | 296/76 |
| 3,240,510 | 3/1966 | Spouge | 242/107.4 R |
| 3,294,339 | 12/1966 | Fontaine | 242/107.4 R |
| 3,308,902 | 3/1967 | Carter | 242/107.4 R |
| 3,971,589 | 7/1976 | Elrod | 292/262 X |
| 4,188,061 | 2/1980 | Shehi | 296/76 |
| 4,529,143 | 7/1985 | Kanada et al. | 242/107.4 R |
| 4,659,122 | 4/1987 | Miller | 292/262 |
| 4,702,094 | 10/1987 | Peterson | 70/257 X |
| 4,823,059 | 4/1989 | Compeau et al. | 292/341.16 X |
| 4,866,963 | 9/1989 | Leininger et al. | 292/144 X |

FOREIGN PATENT DOCUMENTS

| | | | |
|---|---|---|---|
| 0203824 | 12/1986 | European Pat. Off. | 296/76 |
| 3744083 | 7/1989 | Germany | 296/76 |
| 1016223 | 1/1966 | United Kingdom | 242/107.4 R |

*Primary Examiner*—Lloyd A. Gall

*Attorney, Agent, or Firm*—Vickers, Daniels & Young

[57] ABSTRACT

A motor vehicle security device preventing unauthorized entry into a vehicle compartment includes a locking reel mounted in the compartment and a cable between the locking reel and compartment closure. The unwinding of the cable from the locking reel to release the compartment closure is remotely controlled. An emergency mounting release and release circuit are provided for respectively dismounting the locking reel and deactivating the security device and thus allowing access to the vehicle compartment.

20 Claims, 8 Drawing Sheets

24
5
4
22
26
25
6
29
20
38
54
50
46
51
70b
62
31
70
52
53
40
42
47
56
30
60
44
43
83
34
102
100
104a
100a
100b
105
105
A
104b
64
102
82
82
106
83
39
106
70a
57
36
56
61
71
53
32
33
81
22
28
5
4
82
86b
89
81
79
91
94
85
84
80
88
90a
90
92
88
6
86a
86

22
26
31
29
62
70
70a
100
64
60
A
61
32
86b
81
82
79
91
80
89
84
94
88
90a
90
88
86a
92
86

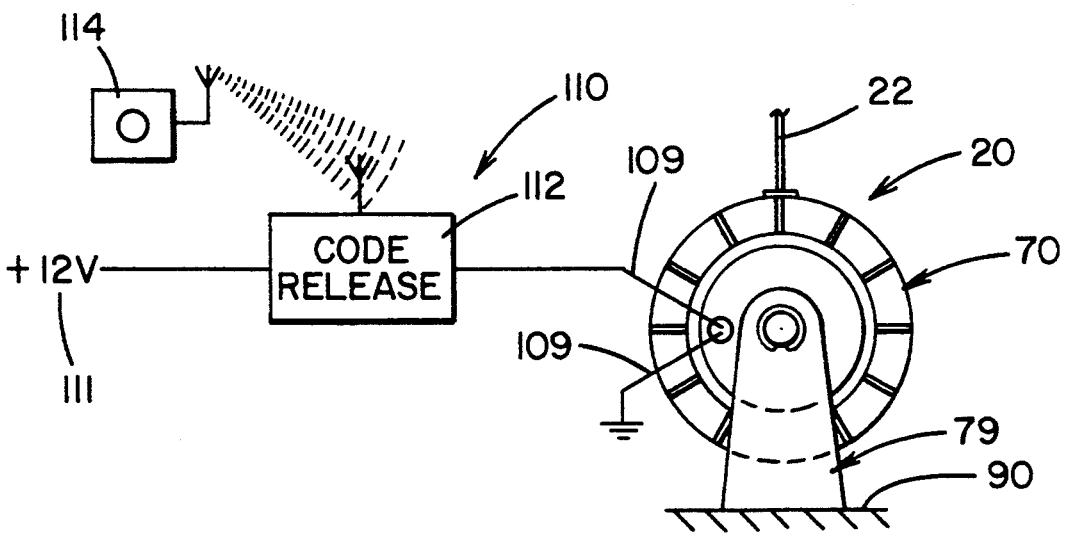
FIG. 8
FIG. 9
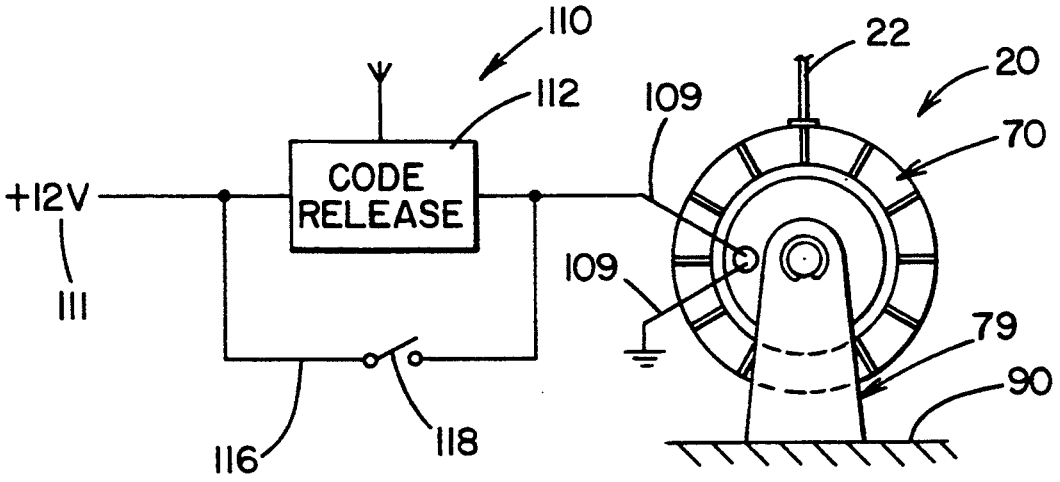

HOOD LOCK WITH REEL AND CABLE

The present invention relates to the art of security devices for motor vehicles and, more particularly, to a self-contained security device which secures the hood of a motor vehicle.

THE BACKGROUND OF THE INVENTION

Over the past several years, there has been a growing demand by vehicle owners to better secure their vehicles against theft. Factors such as insurance premiums and inconveniences associated with the theft of the vehicle have increased the demand to secure a vehicle. In an effort to solve these security problems and demands, a substantial industry has been developed to manufacture and promote various mechanisms for hindering the ease by which an automobile or other motor vehicle can be stolen. These devices include steering wheel locks, alarm systems and devices which disable certain essential components of the vehicle when a theft is attempted. Most of these devices are assembled onto a vehicle after it leaves the manufacturing plant. Thus, professional retailers sell many of the security devices and install them for a substantial labor charge. Such after-market installation involves separate wiring and/or knowledge of the particular vehicle on which the device is being mounted. Many of these devices are expensive and too complex for the general public to self-assemble- For this reason, many vehicles do not have security devices. Most of the electronic systems that are installed in motor vehicles are powered by the standard battery of a motor vehicle located in the engine compartment of the vehicle. Many of the electronic security devices detect motion inside or outside the vehicle and disable certain essential components of the vehicle when the security device is activated; however, the security systems usually do not include a mechanism by which the hood of the vehicle is secured to prevent a thief from disabling the electronic security system by disengaging the system from the battery or bypassing the system through the electrical system located in the engine compartment. The battery of the vehicle itself has also become a target for thieves due to the high cost of certain vehicle batteries. The standard latch system, which secures the hood in the closed position, provides inadequate security against a thief from opening the hood through the grill of the car and/or using a device such as a crow bar to force the hood open. Prior security locking designs for vehicle hoods include bolting the hood to the vehicle frame or providing a latch secured by some type of locking pin. These locking designs require the locking mechanism to be accurately aligned and typically require professional installation. In addition, these locking designs allow the hood to slightly move so that thieves could easily insert a device between the hood and vehicle frame and pry the hood open. Due to the dependency of many electronic security systems on a standard battery of a motor vehicle and inadequate prior hood security devices, there is a substantial need for a security device which can be installed onto the vehicle by an untrained person in a relatively short period of time which can secure the hood of a vehicle against the thief.

THE SUMMARY OF THE INVENTION

The present invention relates to a self-contained security device adapted to be connected to a compartment closure to maintain the compartment closure closed about a compartment on a vehicle.

In accordance with a preferred embodiment of the present invention, there is provided a security device connected to the interior of the frame of the engine compartment and the hood of a vehicle. The security device can be mounted onto the vehicle frame in a location that is not readily accessible from the undercarriage of the vehicle. The security device includes a locking reel and a security cable. One end of the security cable is attached to the locking reel and the other end is attached to the vehicle hood. The security cable can be attached to the underside of the vehicle hood to prevent tampering with the security cable when the vehicle hood is in a closed position. The security cable is wound around the locking reel when the vehicle hood is closed and unwound from the locking reel when the vehicle hood is opened. The security device can be mounted on various vehicle compartment closures such as a vehicle hood, a trunk lid, a vehicle door, etc. The security device secures the hood in a closed position by preventing the security cable from unwinding from the locking reel until the security device is deactivated. A locking mechanism is used to control the movement of the locking reel. The locking mechanism can be designed to allow the security cable to wind, but not unwind, about the locking reel when the locking mechanism is engaged. The locking mechanism can include a locking disk which can be moved to engage and disengage with the locking reel. A ratchet and pawl mechanism can be used for locking the locking reel in position by the locking disk. The engagement and disengagement of the locking disk and the locking reel may be by a mechanical mechanism and/or an electrical mechanism.

In accordance with yet another feature of the present invention, the security device includes a mechanical mechanism which maintains tension on the security cable to tightly secure a compartment closure in a closed position to prevent closure vibration during vehicle movement and to prevent a thief from using a device to pry open the compartment closure. A spring winding mechanism attached to the locking reel can be used to provide the tension on the security cable.

In accordance with another feature of the present invention, the security device includes a mounting system for easy and convenient mounting of the security device in a vehicle compartment. The security device can be mounted in all practical locations in the vehicle compartment. The mounting system eliminates the need for exact alignment of the security device between the vehicle compartment and compartment closure, thereby providing for easier installation.

In accordance with another feature of the present invention, there is provided a mount release to detach the security device from the vehicle. The mount release allows the vehicle owner to open the vehicle compartment closure without having to disengage the locking mechanism. The mount release may be used when the locking mechanism is not properly working or the vehicle owner does not have the controller to deactivate the locking mechanism.

In accordance with still yet another feature of the present invention, there is provided a control system which activates and deactivates the locking mechanism. The control system may include an electrical release circuit which, upon receiving a signal, disengages and- /or engages the locking mechanism. The control system may also include an override circuit.

The primary object of the present invention is to provide a security device which secures a compartment closure in a closed position relative to a compartment of a vehicle.

Another object of the present invention is to provide a security device of the foregoing character which includes a locking reel and a security cable connected to the vehicle compartment closure wherein the security cable is wound around the locking reel to securely maintain the compartment closure in a closed position.

Yet another object of the present invention is to provide a security device of the foregoing character having a locking mechanism which locks the locking reel in position to prevent unauthorized opening of the compartment closure.

Still yet another object of the present invention is to provide a security device of the foregoing character which applies tension to the security cable when the vehicle compartment closure is in a closed position to prevent vibration of the compartment closure.

Another object of the present invention is to provide a security device of the foregoing character having a mount release for detaching the security device from the vehicle compartment when the locking mechanism cannot be disengaged.

Still another object of the present invention is to provide a security device of the foregoing character having a locking mechanism override.

Yet another object of the present invention is to provide a security device of the foregoing character having a control circuit which, upon receiving a signal, allows a vehicle compartment to be opened.

Yet still another object of the present invention is to provide a security device of the foregoing character including an override for the control circuit.

Another object of the present invention is to provide a security device which is easily installable in a vehicle and eliminates the need for accurate alignment during installation.

Yet another object of the present invention is to provide a security device which secures a vehicle compartment in a tight closed position to deter prying of the compartment open by a thief.

Still yet another object of the present invention is to provide a security device which can be economically installed in a vehicle.

These and other objects and advantages will become apparent to those skilled in the art upon reading the following description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein;

FIG. 8 illustrates a control circuit for disengaging and engaging the security device;

FIG. 9 illustrates a control circuit including an override circuit; and,

DETAILED DESCRIPTION OF PREFERRED EMBODIMENTS

Figure 1:
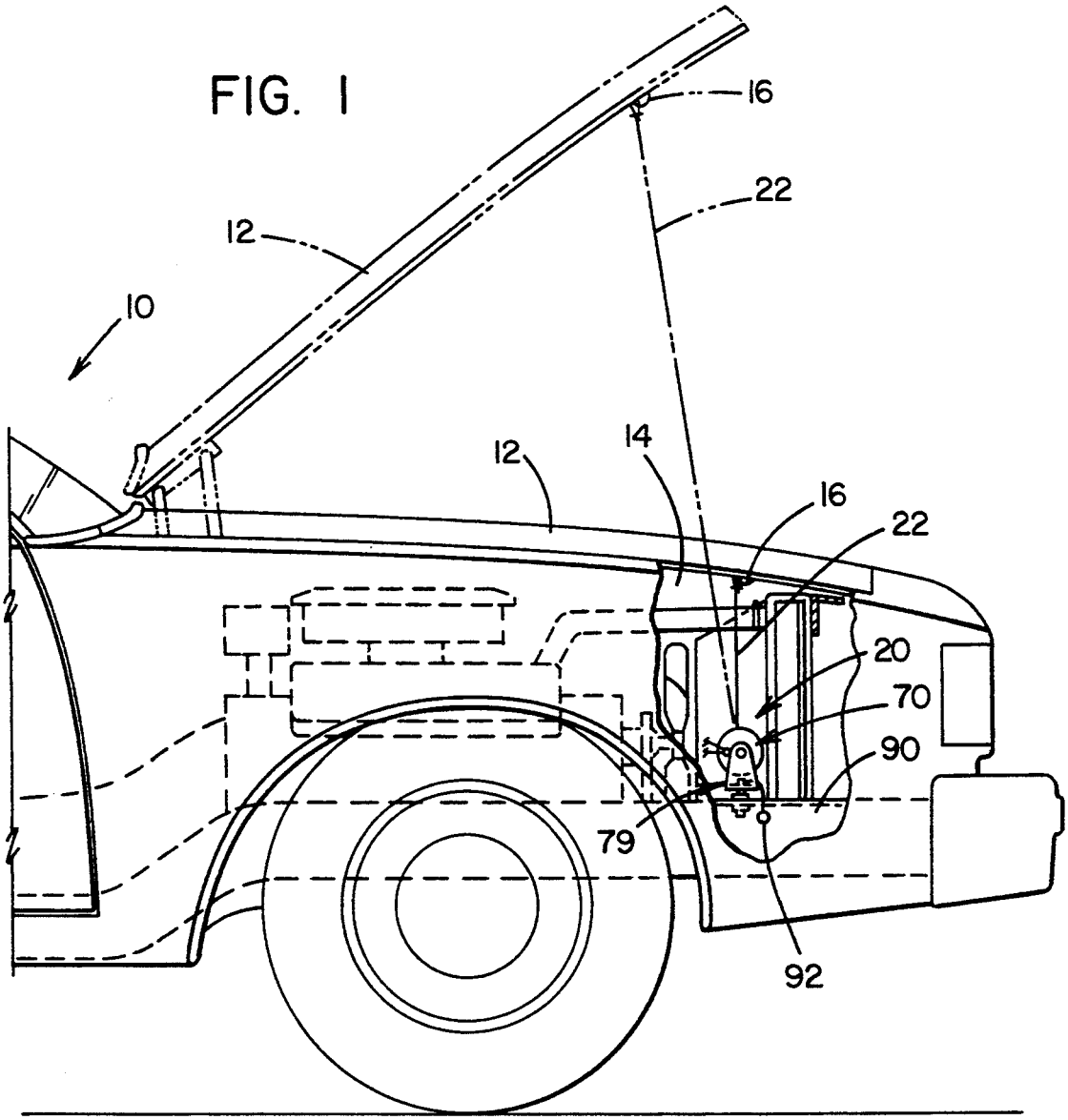
FIG. 1 is a side view of the engine compartment of a vehicle, partially in section, containing a security device in accordance with the present invention, shown attached to the engine compartment and to the vehicle hood in an open and closed position.

Referring now to the drawings, wherein the showings are for the purpose of illustrating the preferred embodiments of the invention only and not for the purpose of limiting the same, in FIG. 1 there is shown a vehicle 10 having a hood 12 for closing an engine compartment 14 containing a security device 20 in accordance with the present invention. FIG. 1 illustrates security device 20 mounted on vehicle frame 90 and security cable 22 of security device 20 connected to vehicle hood 12. Security cable 22 remains connected to vehicle hood 12 in both the open and closed position of hood 12 as illustrated in FIG. 1. Security cable 22 can be attached to vehicle hood 12 via hood ring 16. Hood ring 16 is preferably welded to the underside of hood 12, but can be attached in some other manner. Security cable 22 is looped through hood ring 16 and the formed loop is connected together by cable bolt 24. Security cable may alternatively be attached to the hood by looping the security cable through a pre-existing or formed hole in the hood and securing the cable by cable bolt 24.

Figure 2:
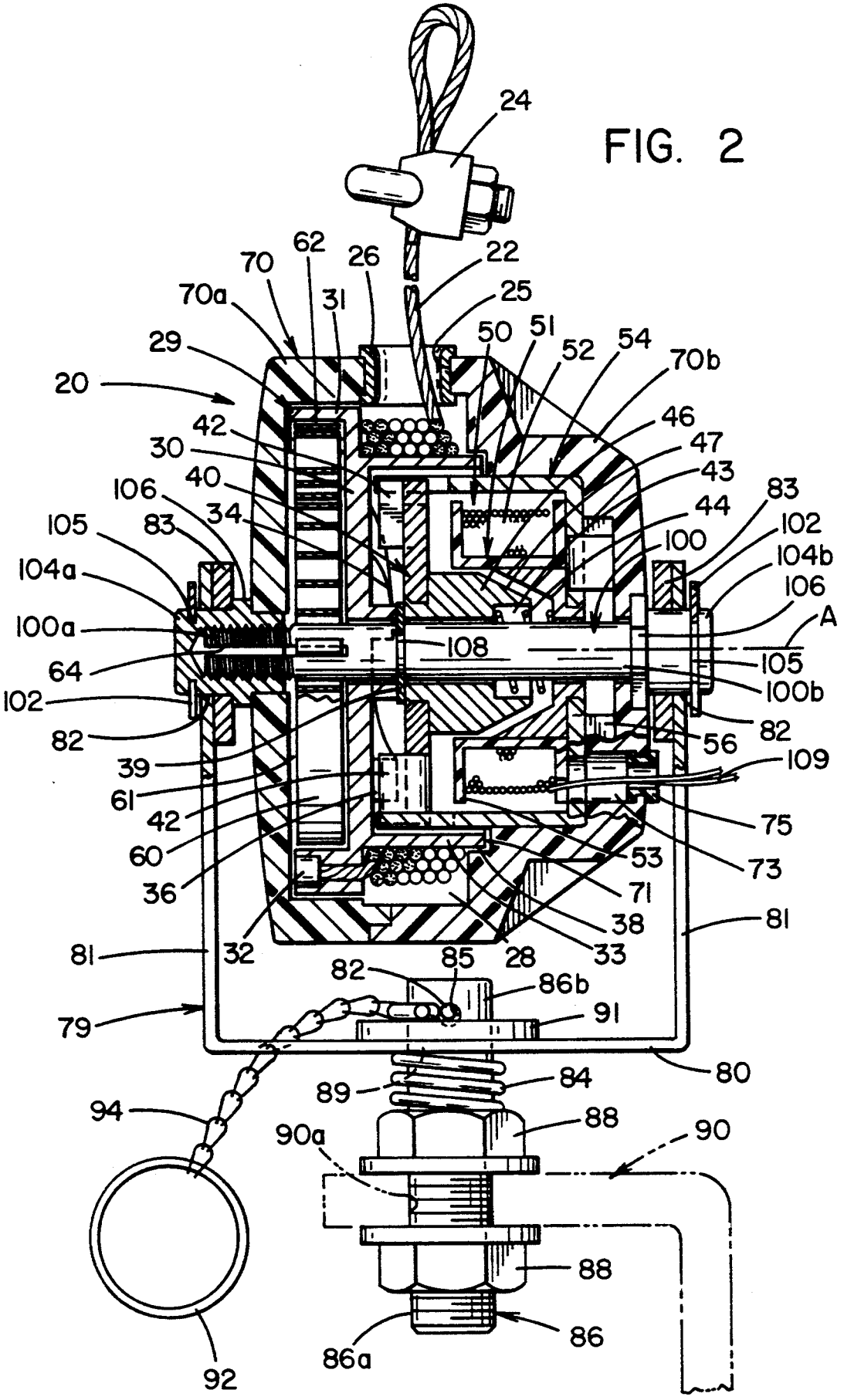
FIG. 2 is a sectional elevation view of the security device illustrating the locking reel and locking disk of the device in an engaged mode.
Figure 3:
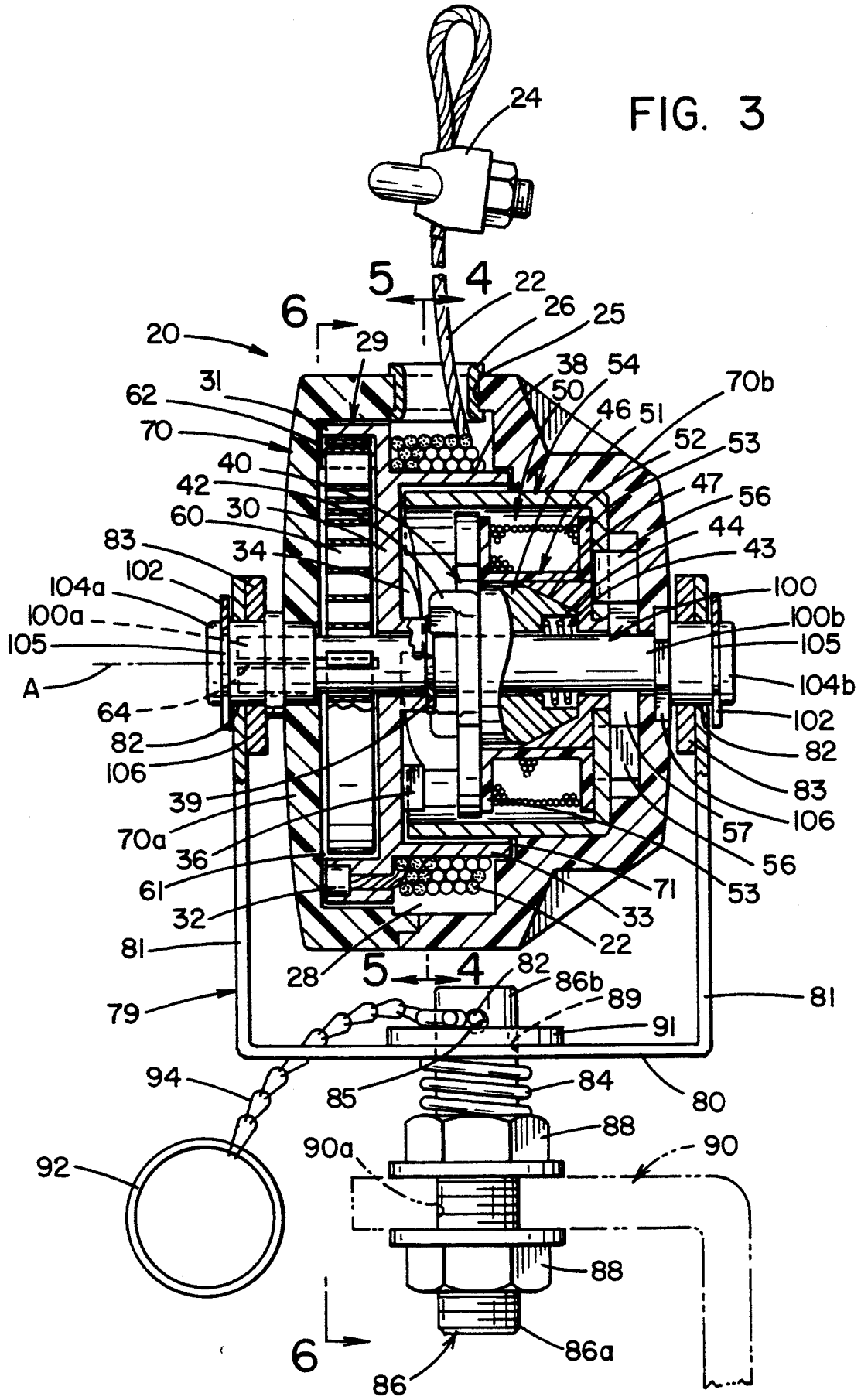
FIG. 3 is a cross-sectional elevation view of the security device illustrating the locking reel and locking disk of the device in a disengaged mode.
Figure 4:
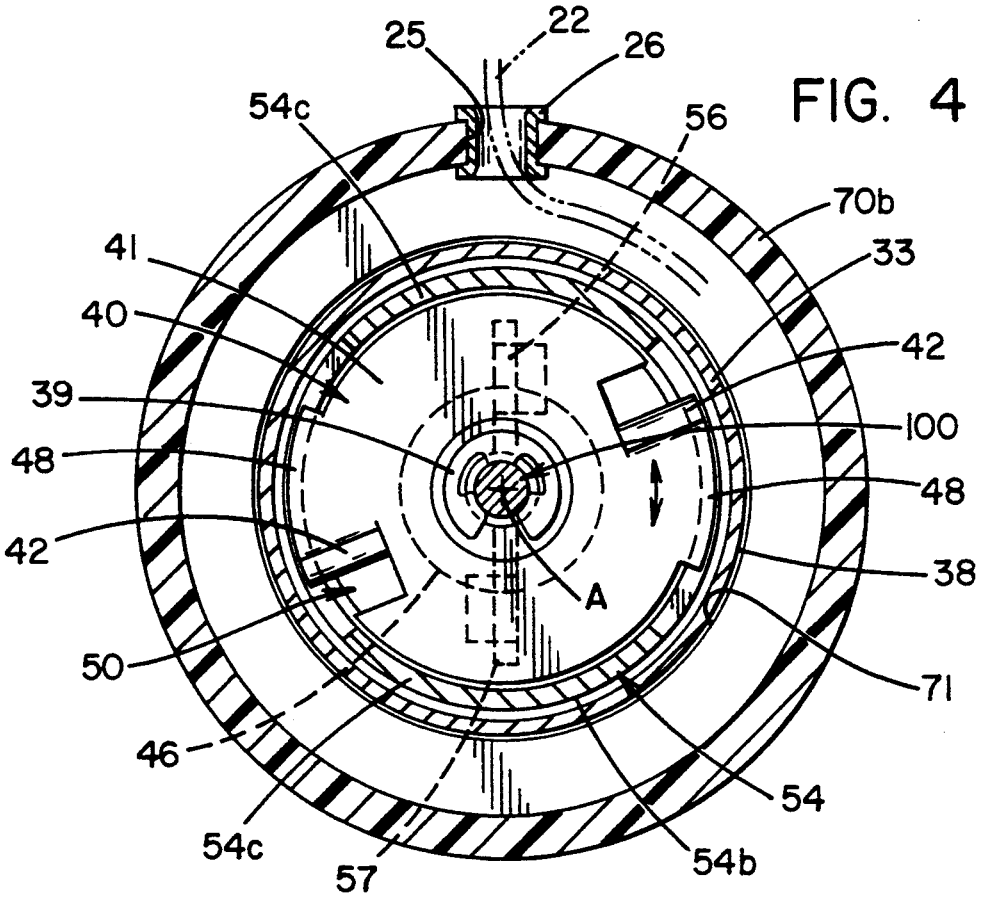
FIG. 4 is a cross-sectional elevation view taken along line 4—4 of FIG. 3.
Figure 7:
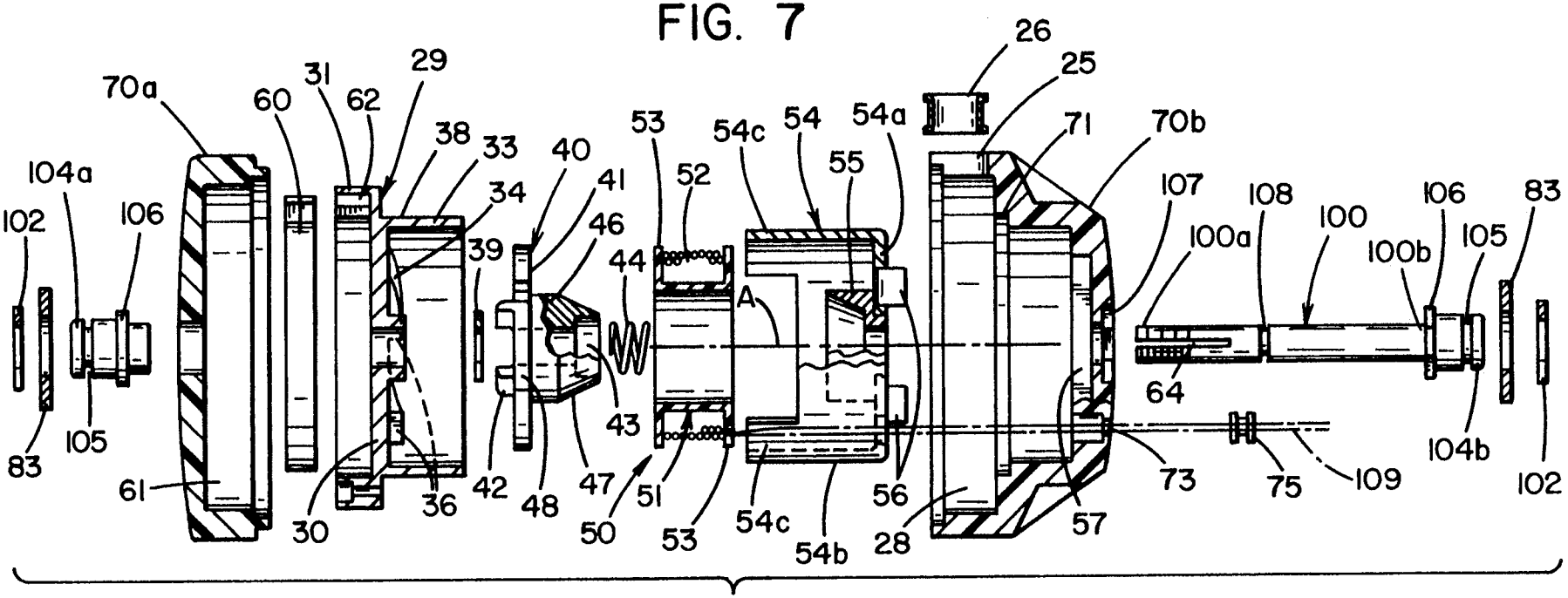
FIG. 7 is an exploded view in section of the anti-theft device of FIG. 3.

Referring now to FIGS. 2, 3 and 7, security device 20 includes a security housing 70 having two components **70*a* and 70*b* which provide opposed walls and a peripheral side wall therebetween. Security housing 70 has an internal configuration such that several of the internal components of security device 20 are supported and/or affixed therein. The housing is made of an impact-resistant material that preferably resists corrosion. The housing may be made of a strong polymer or a corrosion-resistant metal. Housing 70 also protects the security device 20** internal components from foreign objects damaging and/or interfering with the operation of the internal components and protects the internal components from corrosion and undue wear.

Security device 20 includes an elongated axial rod 100 which extends through housing 70 and defines the central axis A of security device 20. Axial rod 100 has two ends **100*a* and 100*b* which extend through openings in housing component 70*a* and 70*b* respectively. Axial rod 100 has a rod head attached to each end of axial rod 100. Preferably, rod head 104*b* is permanently attached to rotational rod end 100*b*. Rod end 100*a* is preferably threaded such that rod head 104*a* is screwed onto rod end 100*a*. Rod heads 104*a* and 104*b* each include an abutment flange 106 which abuts against the exterior surface of housing components 70*a* and 70*b* respectively to maintain the axial rod in secure position with respect to the security device housing. Abutment flange 106 of rod end 104***b* includes a faceted surface which rigidly interacts with security device housing component 70*b* to prevent axial rod 100 from rotating with respect to the security device housing. Preferably, housing component 70*b* has a facet shaped opening 107 which tightly receives the faceted surface. The opening in housing component 70*a* for rod head 104*a* is circular so that rod head 104*a* can be screwed onto rod end 100*a* and partially into the circular opening.

Security device 20 includes a locking reel 29 contained within the interior of housing component 70*a* and rotatably mounted on axial rod 100 adjacent to rod end 100*a*. Locking reel 29 includes a reel plate 30 which extends radially from the axial rod to the inner side of peripheral side wall of housing 70*a*. Locking reel plate 30 preferably has a generally circular design; however, other designs can be used. Locking reel plate 30 includes a peripheral flange 31 perpendicularly connected to the outer edge of locking reel plate 30 and extending parallel to central axis A and toward the end wall of housing 70*a*. A winding compartment 61 is positioned between housing 70*a* and locking reel plate 30 and is formed by the reel plate 30, flange 31 and the interior of the end wall of housing 70*a*. Reel plate 30 also includes a cable supporting flange 33 perpendicularly connected to the reel plate and extending parallel to central axis A and axially inwardly of housing 70 into a notch or shoulder 71 on the inner surface of housing 70*b* to form cable compartment 28 for security cable 22. Cable compartment 28 is defined by the interior of the side wall of housing 70*b*, shoulder 71, cable supporting flange 33 and the radially outer portion of locking reel plate 30. Security cable 22 is wound about cable surface 38 of cable flange 33. Security cable 22 is connected to flange 31 of locking reel plate 30, such as by a cable lock 32. Cable lock 32 is preferably in the form of an enlarged head element received in a recess, not designated numerically, located on flange 31; however, any other mechanism which securely connects security cable 22 to locking reel plate 30 can be used. Cable flange 33 is preferably connected radially inwardly of the outer edge of locking reel plate 30 so that cable compartment 28 is large enough for security cable 22 to be completely wound about cable surface 38 of cable flange 33. Security cable 22 is preferably made of a strong, flexible, resilient material such as a metallic cord or synthetic rope that will readily wind and unwind about cable surface 38 and will not easily break, tear or deteriorate under normal operating conditions. Opening 25 and sleeve 26 allow security cable 22 to move between cable compartment 28 and the outer side wall of security housing 70. A cable aperture 25 is located in the outer side wall of housing compartment 70*b* between housing components 70*a* and 70*b* and receives a guide sleeve 26. Sleeve 26 is cylindrically shaped and includes a hollow interior opening having a diameter of sufficient size to allow security cable 22 to freely move therethrough. Preferably, cable bolt 24 cannot pass through the opening provided by sleeve 26. Sleeve 26 preferably includes smooth and tapered edges to facilitate the movement of security cable 22 through the cable aperture.

Figure 5:
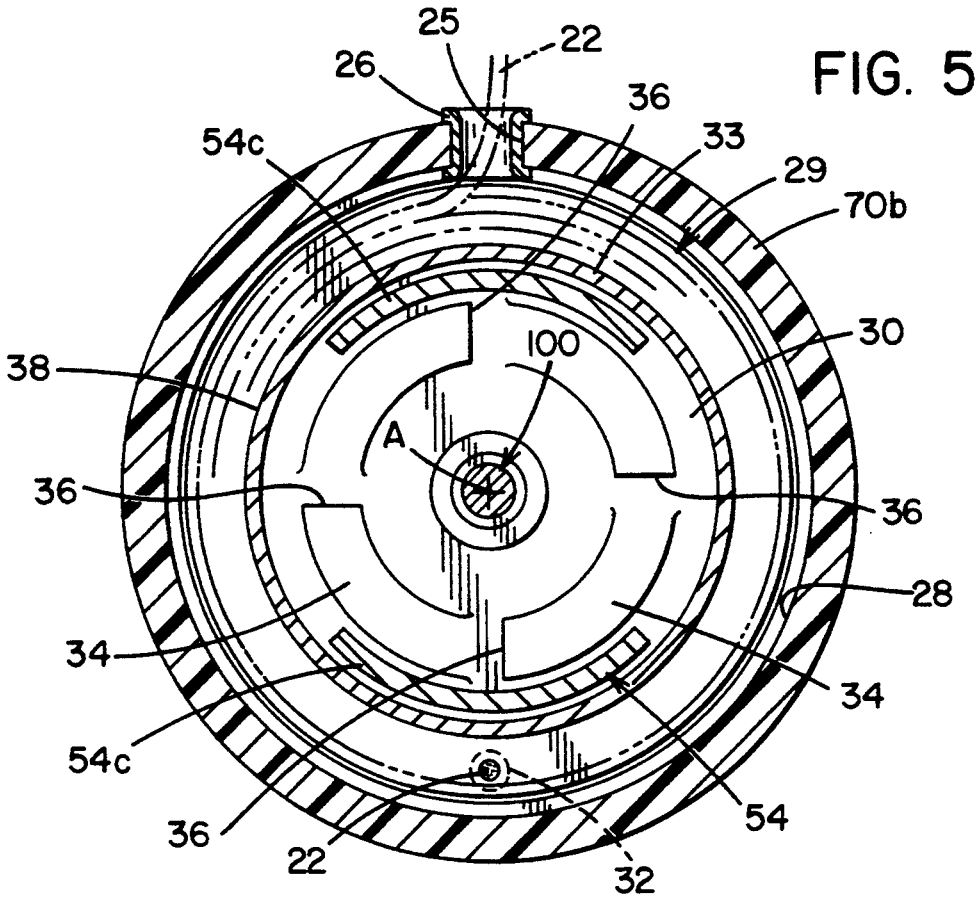
FIG. 5 is a cross-sectional elevation view taken along line 5—5 of FIG. 3.

As best illustrated in FIGS. 5 and 7, locking reel plate 30 includes four sloped surfaces 34 and four abutment faces 36. Sloped surfaces 34 and abutment faces 36 are located on the side of locking reel plate 30 facing away from the end wall of housing component 70*a* and towards housing component 70*b*. Each sloped surface 34 is arcuate in shape relative to axis A and a uniform radial distance from the axis. Sloped surface 34 gradually rises from the surface of locking reel plate 30 and then sharply falls to form abutment face 36. Preferably, sloped surfaces 34 and abutment faces 36 are radially positioned on locking reel plate 30 between central axis A and cable flange 33. Locking reel 29 is held in position on axial rod 100 along central axis A by housing component 70*a* on one side and reel retaining ring 39 on the other side of the locking reel. Retaining ring 39 is a "C"-shaped disk which snaps into axial rod 100 in ring groove 108.

Figure 6:
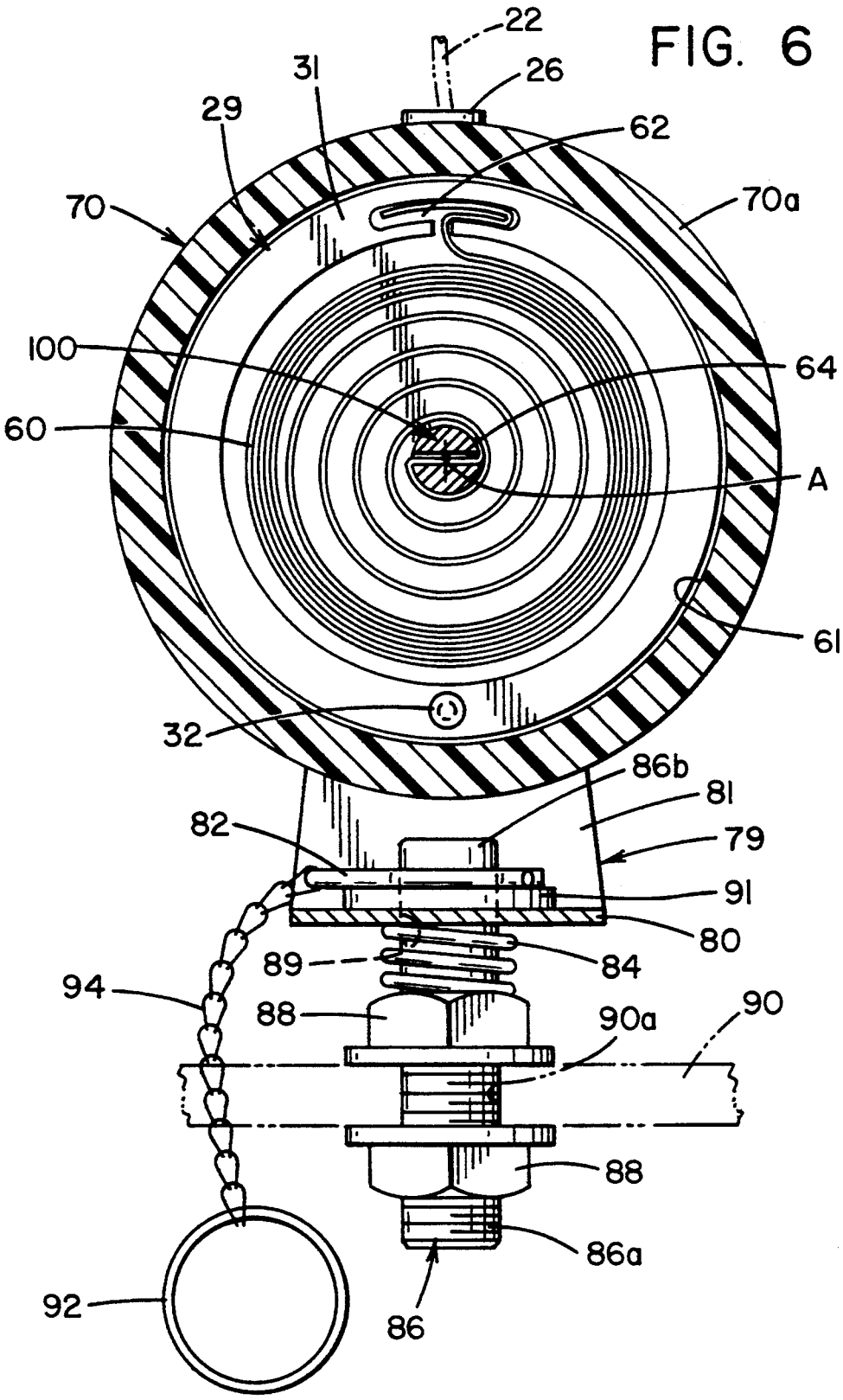
FIG. 6 is a cross-sectional elevation view taken along line 6—6 of FIG. 3.

Security device 20 includes a winding mechanism which rotates locking reel 29 about axial rod 100. The winding mechanism may be mechanical or electrical and is located in winding compartment 61. Preferably, the winding mechanism maintains a force on locking reel 29 such that security cable 22 is under tension when vehicle hood 12 is closed. The winding mechanism may also be designed to constantly maintain a tension on security cable 22 when vehicle hood 12 is in the open or closed position. Preferably, the winding mechanism is a spring 60 as illustrated in FIG. 6. Spring 60 is coiled about the axial rod and lies in a plane perpendicular to the central axis. One end of spring 60 is connected to the axial rod at rod slot 64. Rod slot 64 is a slit in the axial rod extending along the central axis and through rod end 100*a* and partially into the body of the axial rod. The other end of spring 60 is connected to locking reel 29 at reel slot 62 on flange 31. Reel slot 62 is "T"-shaped to receive the end of spring 60.

Security device 20 includes a locking disk 40 contained within housing component 70*b* and axially slidably mounted on axial rod 100 adjacent to reel retaining ring 39. The body 41 of locking disk 40 extends radially from central axis A to the innerside of cable flange 33. As illustrated in FIGS. 2, 3, 4 and 7, two lock tabs 42 protrude from the body of locking disk 40 and extend toward locking reel 29. Staked to and protruding from the opposite face of locking disk body 41 is disk core 46. Disk core 46 is cylindrically shaped and has a conical end 47 extending axially toward housing component 70*b*. Locking disk 40 is maintained against rotation about the axial rod by a cup shaped solenoid housing 54 having an end wall 54*a* and a cylindrical side wall 54*b* which is cut away of its axially inner end to provide arcuate fingers 54*c* positioned about axial rod 100. The outer periphery of body 41 of locking disk 40 is circumferentially recessed to provide two diametrically opposed tabs 48 adjacent to lock tabs 42 and which are received between circumferentially adjacent ends of fingers 54*c* to allow locking disk 40 to move axially on axial rod 100 but not around the rod and central axis A. Solenoid housing 54 includes coil support 55 which is positioned on the inner side of solenoid housing and wall 54*a* and which is conically shaped internally to receive conical end 47 of disk core 46 when locking disk 40 is moved into solenoid housing 54 as set forth hereinafter. Tapered end 47 of disk core 46 is provided with recess 43 which receives biasing spring 44 located about the axial rod. Spring 44 is axially captured between recess 43 and the inner end of coil support 55 of solenoid housing 54. A solenoid coil housing 51 is non-rotatably positioned inside solenoid housing 54 and about coil support 55. Coil housing 51 includes two flanges 53 forming a "U"-shaped trough in which solenoid coil 52 is received. The end wall 54*a* of solenoid housing 54 includes two tabs 56 which extend axially outwardly therefrom and engage with recesses 57 in the interior of the end wall of housing component 70*b* to prevent solenoid housing 54 from rotating about the axial rod with respect to housing 70. Housing component 70*b* includes an aperture 73 for a grommet 75 through which ends 109 of solenoid coil 52 pass for connecting with an external electrical source such as the car battery.

As illustrated in FIGS. 8 and 9, coil ends 109 are connected to a control circuit 110. Control circuit 110 includes a power source 111, preferably the vehicle battery, connected to a code release 112. Code release 112 is selectively activated and deactivated by a remote transmitter 114 which sends a specified code to code release 112. Upon receiving an authorized code, code release 112 opens or closes control circuit 110 for the purpose set forth hereinafter. In an alternate embodiment illustrated in FIG. 9, control circuit 110 includes an override circuit 116 which includes an override switch 118 which can open and close control circuit 110 without activating code release 112.

Security device 20 is mounted on vehicle 10 by a mount assembly or system. As best illustrated in FIGS. 2, 3 and 6, the mount assembly includes a "U"-shaped mounting frame 79 having a base section 80 and two side sections 81 perpendicularly connected to each end of the base section. Each side section has a hole 82 therethrough and frame 79 supports security device 20 by receiving rod head 104*a* in one of the holes 82 and rod head 104*b* in the second hole 82. A washer 83 is preferably placed on each rod head prior to inserting the rod heads into the respective hole 82 on the mounting frame. Each rod head is locked to the mounting frame by inserting a split retaining clip 102 about the rod head in groove 105 provided therefore on rod head 104. Washers 83 and rod clips 102 prevent the rod heads from axially disengaging from the mounting frame and allow the rod heads and thus rod 100 and housing 70 to rotate about axis A. Base 80 of mounting frame 79 is connected to a mounting shaft 86 which in turn is bolted to a vehicle frame 90 within vehicle compartment 14. Mounting shaft 86 has a threaded end 86*a* and a non-threaded end 86*b*. The threaded end is inserted into a hole 90*a* in vehicle frame 90 and two nuts 88 secure the threaded end of shaft 86 to vehicle frame 90. A biasing spring 84 is placed about the unthreaded end of shaft 86 between base 80 and the adjacent nut 88. Base 80 of the mounting frame is inserted onto shaft 86 by inserting unthreaded end 86*b* of the shaft through hole 89 in the base until the base rests on spring 84. A shaft washer 91 is then positioned about shaft end 86*b* to rest upon base 80. The frame is then depressed to compress spring 84, and release pin 82 is placed into pinhole 85 in shaft 86 to prevent the mounting frame from being removed from the mounting shaft. Spring 84 applies a force to base 80 to releasably lock release pin 82 in pinhole 85. Release pin 82 is preferably connected to one end of a chain 94 having a ring 92 on the other end thereof. It will be appreciated from the foregoing description that the mounting system allows the mounting frame to rotate about mounting shaft 86 and housing 70 and axial rod 100 to rotate about axis A within the mounting frame.

Figure 10:
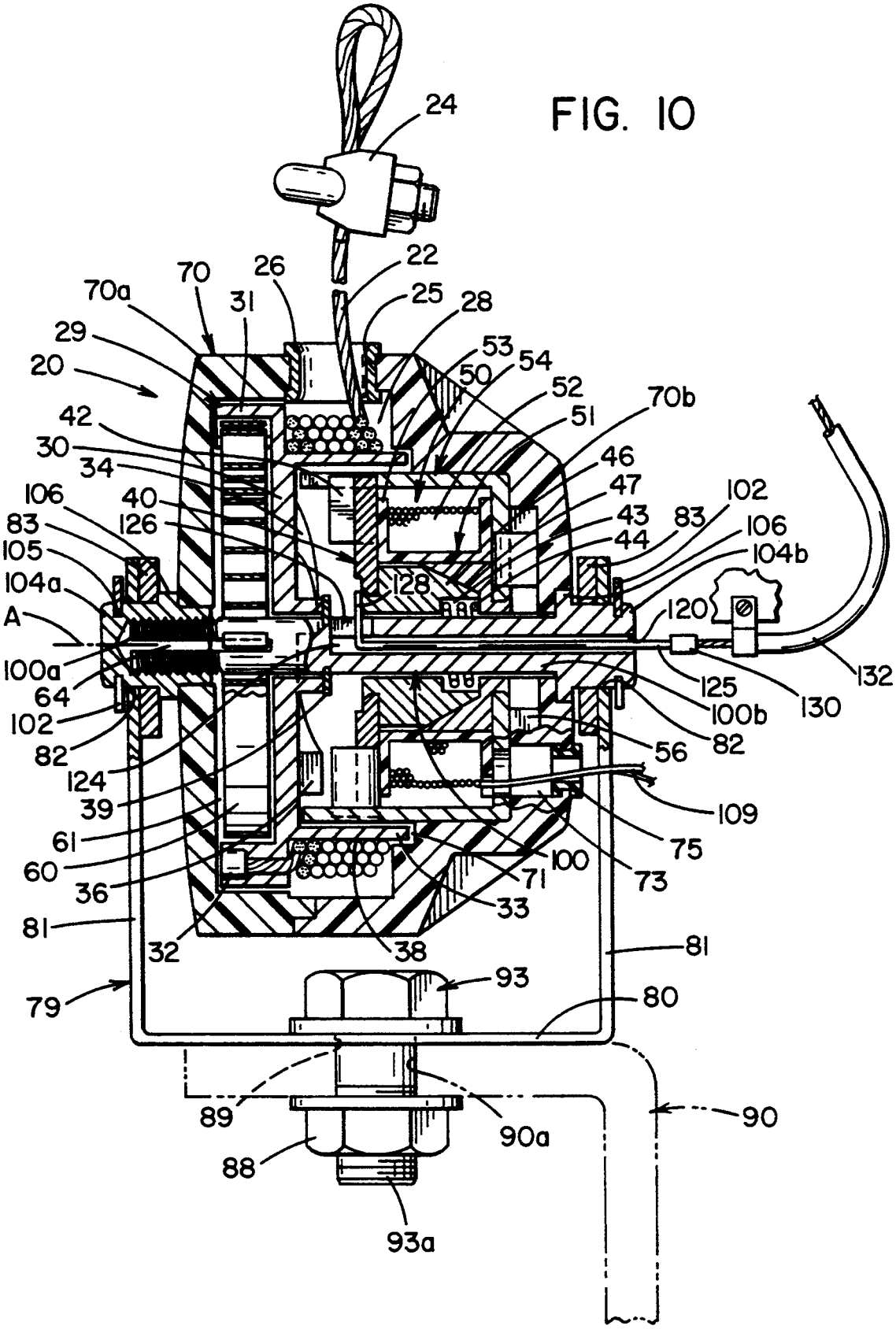
FIG. 10 illustrates a cross-sectional elevation view of the security device illustrating the locking mechanism override.

An alternative mounting arrangement is illustrated in FIG. 10. Mounting frame 79 is attached to rod ends 100*a* and 100*b* as previously described above with reference to FIGS. 2 and 3. Base 80 of mounting frame 79 is bolted to vehicle frame 90 by bolt 93. Bolt 93 has a threaded end 93*a*. Threaded end 93*a* is inserted through hole 89 in base 80 of mounting frame 79 and through hole 90*a* in vehicle frame 90. Nut 88 is secured to thread end 93*a* to secure the mounting frame to the vehicle frame. Mounting frame 79 may alternatively be attached by welding base 80 directly to frame 90.

FIG. 10 also illustrates an alternative embodiment whereby locking disk 40 can be manually disengaged from locking reel 29. Axial rod 100 includes a hole 120 through rod end 100*b* and rod head 104*b* and which partially transverses the central axis of the axial rod wherein a release wire 125 is inserted therein. Wire 125 is made of resilient material that does not easily bend. Hole 120 terminates at hole end 124 which is located between the point where locking disk and locking reel 30 are located on axial rod 100. A slot 126 is cut into the surface of axial rod 100 forming a passage between hole 120 and the surface of rod 100. Slot 126 is formed at hole end 124 and partially extends along rod 100 central axis toward rod end 100*b*. Release wire 125 includes an elbow section 128 wherein the wire radially extends from hole 120 through slot 126 and slightly beyond the outer edge of rod 100. The end of wire 125 extending from rod end 100*b* includes a connecting sleeve 130 wherein a cable 132 is connected to wire 125.

Operation of security device 20 will be understood from the illustrations in FIGS. 1, 2, 3, 8 and 9. As shown in FIG. 1, security device 20 is mounted between vehicle hood 12 and vehicle engine compartment 14. Preferably, security device 20 is mounted to vehicle frame 90 in a place which is not easily accessible from the undercarriage of the vehicle so as to prevent a thief from disengaging the mounting system. The mounting position of security device 20 in vehicle 10 is not critical insofar as alignment is concerned and the device should be mounted in a convenient but secure place to facilitate easy installation. Exact alignment between the mounting frame and hood ring 16 is not necessary for proper operation of device 20; however, the closer the alignment between the mount position in vehicle compartment 14 and the connection point of security cable 22 on compartment closure 12, the tighter and more secure the closure 12 on compartment 14. Preferably, security device 20 is mounted near the front of the engine compartment and in a position such that cable 22 is not obstructed from unwinding and winding about locking reel 29.

When vehicle hood 12 is closed and security device 20 is activated, as illustrated in FIG. 2, security cable 22 maintains the vehicle hood 12 in a closed position due to locking disk 40 preventing locking reel 29 from rotating in the direction to unwind security cable 22, which direction is clockwise in FIG. 5 and counterclockwise in FIG. 6. Thus, when security device 20 is activated, locking disk 40 engages locking reel 29 and only allows the locking reel to rotate in a counterclockwise direction in FIG. 5. The controlled rotation of locking reel 29 results from the interaction between locking protrusions 42 on locking disk 40 and sloped surfaces 34 and abutments 36 on locking reel 29. Surfaces 34 slope in the direction whereby when locking reel 29 rotates in the counterclockwise direction in FIG. 5, locking protrusions 42 slide along surfaces 34 allowing locking reel 29 to rotate. Spring 44 biases locking disk 40 and thus projections 42 to the left in FIG. 2, and the space between core 46 and coil support 55 allows projections 42 to slide along surfaces 34 against the bias of spring 44. When locking reel 29 is in the position shown in FIG. 2, locking protrusions 42 contact the abutment surfaces 36 preventing locking reel 29 from rotating in a clockwise direction in FIG. 5 to unwind security cable 22. When vehicle hood 12 is in the closed position, winding spring 60 maintains a counterclockwise bias on locking reel 29 to produce a tension on security cable 22 which tightly closes vehicle hood 12 thereby reducing hood vibration and frustrating a thief's attempt to pry vehicle hood 12 open.

When the vehicle owner desires to open vehicle hood 12, the vehicle owner activates remote transmitter 114 which sends a coded signal to code release 112. Code release 112 screens the remote signal and, upon receiving the proper coded signal, activates control circuit 110 to allow current to pass from power source 111 to solenoid coil 52. Power source 111 is preferably a vehicle battery but can be some other power source. Control circuit 110 may also include an override circuit 116 to activate solenoid 50 without having to activate code release 112 by remote transmitter 114. Override circuit 116 is activated by override switch 118. The override switch generally is activated by a key, code pad, standard switch or other type of signal producing device. Preferably, override switch 118 is concealed in vehicle 10 so that a thief cannot easily deactivate security device 20. Solenoid coil 52, upon receiving current from control circuit 110, creates a magnetic field which draws disk core 46 to the right in FIG. 2 and into coil support 55 to the position shown in FIG. 3 thereby moving locking disk 40 and thus projections 42 away from locking reel 29 and allowing the locking reel to freely rotate clockwise in FIG. 5 to unwind cable 22 from the locking reel. Thus, once security device 20 is deactivated, the vehicle owner can open vehicle hood 12. Control circuit 110 may include a delay timing device to automatically shut off current to solenoid 50 to automatically reactivate security device 20. Once security device 20 is reactivated, the current flow to solenoid 50 is stopped, which ends the induced magnetic field. When the magnetic field dissipates, spring 44 forces locking disk 40 to the left in FIG. 3 and back to the position shown in FIG. 2 to re-engage locking reel 29 to once again preclude rotation of locking reel 29 in the cable unwinding direction. When the owner closes hood 12, spring 60 rotates reel 29 to rewind cable 22 therein.

Control circuit 110 may be a separate security circuit within vehicle 10 or can be integrated with other vehicle security systems. Security device 20 can be alternatively disengaged by a mount release mechanism, defined in the embodiment disclosed by release pin 82, chain 94 and ring 92. The mount release mechanism is used when control circuit 110 cannot be used, such as when the vehicle battery is dead or the remote transmitter is inaccessible. The mount release mechanism may also be used when locking reel 29 is not operating properly. The mount release mechanism may be an electrical and/or a mechanical device other than that disclosed herein. In the disclosed embodiment, security device 20 is released from vehicle compartment 14 by removing release pin 82 from mount shaft 86. Once release pin 82 is removed, mounting frame 79 can be lifted off of mount shaft 86, thus freeing security device 20 from vehicle compartment 14 thereby allowing vehicle hood 12 to be opened. Release pin 82 is removed from pinhole 85 in mount shaft 86 by manually pulling pin ring 92. Preferably, pin ring 92 and pin chain 94 are concealed to prevent the unauthorized detachment of security device 20 from vehicle frame 90.

Security device 20 can further be disengaged by using the locking mechanism override illustrated in FIG. 10. Locking disk 40 is manually disengaged from locking reel 29 by pulling on cable 132 which is attached to release wire 125. As the cable is pulled, release wire 125 is slightly moved out of hole 120 and moves elbow section 128 within slot 126 toward rod end **100*b*. As elbow section 128 moves toward rod end 100*b* within slot 126, the elbow section engages locking disk 40. As wire 125 is further removed from hole 120, elbow section 128 moves locking disk 40 away from locking reel 29 and allows the locking reel to freely rotate clockwise to unwind cable 22. When cable 132 is released, disk bias 44 forces locking disk 40 to re-engage locking reel 29 thereby moving elbow section 128 in slot 126 toward hole end 124**. The locking mechanism override system can be used instead of or in conjunction with the mount release system to disengage the security device in case of an emergency.

The invention has been described with reference to a preferred embodiment and alternatives thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

We claim:

1. A security device contained in a vehicle compartment for securing a compartment closure in a closed position, said security device comprising:

a) real means mounted in said vehicle compartment and having a reel axis, said reel means including a wind means for rotating said reel means about said reel axis and maintaining a tension on said cable means and wherein said reel means includes a locking reel having at least one sloped surface and abutment face;

b) cable means supported on said reel means for winding and unwinding about said reel axis, said cable means having a free end;

c) attachment means for connecting said free end of said cable means to said compartment closure;

d) releasable lock means for controlling said winding and unwinding of said cable means from said reel means, said releasable lock means including a locking disk biased against said reel means, said locking disk including at least one lock tab; and e) activation means for controlling said releasable lock means, said activation means including an electrical mechanism which when actuated by an authorized person signals said releasable lock means to control unwinding of said cable means.

2. A security device as defined in claim 1, wherein said wind means maintains a tension on said cable means when said compartment closure is in said closed position.

3. A security device as defined in claim 1, wherein said activation means includes solenoid means for releasing said releasable lock means.

4. A security device as defined in claim 3, wherein said solenoid means is powered by battery means.

5. A security device as defined in claim 3, wherein said activation means includes code responsive release means for receiving an external code signal to activate said solenoid means.

6. A security device as defined in claim 5, wherein said activation means includes as override circuit to activate said solenoid means independently of said code responsive release means.

7. A security device as defined in claim 5 and a remote transmitter for generating said external code signal.

8. A security device as defined in claim 7, wherein said activation means includes an override circuit to activate said solenoid means independently of said code responsive release means.

9. A security device as defined in claim 1, including mount means for attaching said reel means to said vehicle in said compartment.

10. A security device as defined in claim 9, wherein said mount means includes mounting release means for detaching said device from said compartment.

11. A security device as defined in claim 10, wherein said mounting release means includes a release pin.

12. A security device as defined in claim 10, wherein said mounting release means includes reel support means and support shaft means for said reel support means, said shaft means being mounted in said compartment, and said mounting release means includes a release pin interconnecting said reel support means and said shaft means.

13. A security device as defined in claim 1, wherein said at least one lock tab on said locking disk engages said abutment face on said locking reel to control the rotation of said locking reel.

14. A security device as defined in claim 13, including manual override means for circumventing said releasable lock means.

15. A security device as defined in claim 14, wherein said manual override means unbiases said locking disk from said locking reel to free rotation of said reel means.

16. A security device as defined in claim 1, wherein said wind means is spring means, said spring means maintaining a tension on said cable means when said compartment closure is in said closed position.

17. A security device as defined in claim 1, wherein said locking disk is coaxial with said reel axis.

18. A security device as defined in claim 1, wherein said activation means includes code signal responsive release means and transmitter means for generating a code signal for activating said code signal responsive release means.

19. A security device as defined in claim 1, including manual override means for circumventing said releasable locking means.

20. A security device as defined in claim 19, wherein said manual override means unbiases said locking disk from said reel means to free rotation of said reel means.

* * * * *